US009923299B2

(12) United States Patent
Cayzac

(10) Patent No.: US 9,923,299 B2
(45) Date of Patent: Mar. 20, 2018

(54) CONNECTOR WITHSTANDING PARTIAL DISCHARGES

(71) Applicant: Amphenol Air LB, Carignan (FR)

(72) Inventor: Gaspard Cayzac, Margut (FR)

(73) Assignee: Amphenol Air LB, Carignan (FR)

( * ) Notice: Subject to any disclaimer, the term of this patent is extended or adjusted under 35 U.S.C. 154(b) by 0 days.

(21) Appl. No.: 15/400,839

(22) Filed: Jan. 6, 2017

(65) Prior Publication Data

US 2017/0194737 A1 Jul. 6, 2017

(30) Foreign Application Priority Data

Jan. 6, 2016 (FR) ..... 16 50073

(51) Int. Cl.

| | |
|---|---|
| ***H01R 13/52*** | (2006.01) |
| ***H01R 13/05*** | (2006.01) |
| ***H01R 13/405*** | (2006.01) |
| ***H01R 13/50*** | (2006.01) |
| ***H01R 24/20*** | (2011.01) |
| ***H01R 24/28*** | (2011.01) |
| ***H01R 13/504*** | (2006.01) |
| ***H01R 13/53*** | (2006.01) |
| *H01R 13/648* | (2006.01) |
| *H01R 107/00* | (2006.01) |

(52) U.S. Cl.

CPC ..... *H01R 13/5221* (2013.01); *H01R 13/052* (2013.01); *H01R 13/405* (2013.01); *H01R 13/50* (2013.01); *H01R 13/504* (2013.01); *H01R 13/53* (2013.01); *H01R 24/20* (2013.01); *H01R 24/28* (2013.01); *H01R 13/6485* (2013.01); *H01R 2107/00* (2013.01); *H01R 2201/26* (2013.01)

(58) Field of Classification Search

CPC ..... H01R 13/052; H01R 13/50; H01R 13/53; H01R 13/405; H01R 13/5221; H01R 13/6485; H01R 24/20; H01R 24/28; H01R 2107/00

USPC ..... 439/279, 88–90, 181, 934

See application file for complete search history.

(56) References Cited

U.S. PATENT DOCUMENTS 3,597,726 A * 8/1971 Appleton ..... H01R 13/5221 439/724
4,443,048 A * 4/1984 Moist, Jr. ..... H01R 43/20 439/599
4,565,416 A * 1/1986 Rudy ..... H01R 13/4364 439/592
4,655,525 A * 4/1987 Hunt, III ..... H01R 13/4367 439/599
4,880,389 A * 11/1989 Mochizuki ..... H01R 24/20 29/858

(Continued)

*Primary Examiner* — Tho D Ta
*Assistant Examiner* — Travis Chambers
(74) *Attorney, Agent, or Firm* — Christensen O'Connor Johnson Kindness PLLC

(57) ABSTRACT

This connector for connecting electrical conductors comprising a contact end fitting at their end to be connected, comprises two conjugate parts (31, 32), respectively male and female, each comprising a body (33) made of insulating material provided with housings (36) into which respectively male and female contacts (41) capable of receiving the contact end fittings of the conductors come to be mounted. At least one of the male and female parts comprises, internally, zones (46) forming partitions placed between said housings and produced from a material capable of withstanding electrical discharges.

12 Claims, 4 Drawing Sheets

(56) References Cited

U.S. PATENT DOCUMENTS

| | | | | | |
|---|---|---|---|---|---|
| 4,938,705 | A * | 7/1990 | Kanno | H01R 13/53 | 439/125 |
| 5,409,405 | A * | 4/1995 | Bungo | H01R 13/4364 | 439/745 |
| 5,820,417 | A * | 10/1998 | Yamada | H01R 13/4368 | 439/686 |
| 6,210,204 | B1 * | 4/2001 | Ko | H01R 13/527 | 439/181 |
| 6,875,035 | B2 * | 4/2005 | Sakiyama | H01R 13/6205 | 439/181 |
| 7,344,400 | B2 * | 3/2008 | Hasegawa | F04C 29/0085 | 439/276 |
| 8,696,367 | B2 * | 4/2014 | Daughtry, Jr. | H01R 12/57 | 439/83 |
| 2015/0140848 | A1 * | 5/2015 | Sato | H01R 13/5202 | 439/271 |

* cited by examiner

CONNECTOR WITHSTANDING PARTIAL DISCHARGES

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present invention relates to the connectors for electrically connecting conductors comprising, at their ends to be connected, a contact end fitting.

A particularly advantageous but nonlimiting application of the invention relates to the connectors ensuring the electrical connection of conductors for aeronautical applications subject to an intense vibratory environment.

Various types of connectors are known from the prior art.

Reference can for example be made to the document FR 2 742 264 which describes a connector provided with means that simply and inexpensively make it possible to ensure a good seal tightness at the interface between the various parts of the connector.

A connector of this type is represented in FIG. 1.

As can be seen, such a connector comprises a male part 1 and a female part 2.

The male part 1 comprises a body 3 made of rigid insulating material, of generally parallelepipedal or other form. Furthermore, the body 3 comprises a set of cylindrical housings or cavities 4 each receiving a bushing with fins 5 intended for locking, in the body 3, a contact element 6 comprising a front pin 7 which passes through a hole 8 provided in the front face 9 of the body 3, in alignment with each housing 4.

The contact element further comprises a median locking collar 10 and a rear section 11 intended to receive a contact end fitting (not represented) fixed to the end of a conductor to be connected.

The bushings 5 are retained in the housings 4 by a retaining element 13 comprising holes 14 aligned with the housings 4 and held in the body 3 by a closure and sealing element 15 made of flexible insulating material which is directly moulded in the open rear end of the body 3.

The element 15 comprises passage holes 16 for the conductors, which are aligned with the housings 4 and which exhibit an alternation of section 17 of small diameter and of section 18 of greater diameter.

On the front face, that is to say on the face opposite the closure part 15, the body 3 comprises, externally, a set of boots 19 which surround the pins 7, gripping them, to ensure the seal tightness at the front of the connector.

With regard to the female part, the latter comprises a form similar to that of the male part.

However, the contact elements 22 comprise, at the front, a bushing 23 instead of a pin. For example, the body 24 is deeper than the body of the male part so as to house the bushings 23. To this end, the body comprises voids 25 extending the housings 4, and passage holes 26 to allow the insertion of the male pins 7 into the bushings 23. The female part moreover does not have any boots provided on the male part 1.

Such a connector is advantageous in as much as it makes it possible to obtain an effective seal tightness and hold each part of the connector without play.

However, the connectors may be subject to partial discharges, which are likely to occur for example upon the connection or the disconnection of the pins and of the bushings. Such electrical discharges are likely to affect the insulating material of the body and, in the long term, affect the electrical insulation properties thereof.

The aim of the invention is therefore to mitigate this drawback and propose a connector in which the electrical insulation properties of the elements involved in the construction thereof are guaranteed in the long term.

The subject of the invention is therefore a connector for connecting electrical conductors comprising a contact end fitting at their end to be connected, comprising two conjugate parts, respectively male and female, each comprising a body made of insulating material provided with housings into which respectively male and female contacts capable of receiving the contact end-fittings of the conductors come to be mounted.

At least one of said male and female parts comprises, internally, zones forming partitions placed between said housings and produced from a material capable of withstanding electrical discharges.

According to another feature of this connector, the material of the partitions is a thermosetting polymer having a CTI index greater than or equal to 600.

It will for example be possible to use a silicone or an epoxy resin.

Advantageously, the partition extends into the body along at least a part of the length of the housings.

According to yet another feature of the connector according to the invention, the zones forming partitions are produced by overmoulding of said material capable of withstanding electrical discharges on the insulating material of the body.

For example, the insulating material of the body is made of thermoplastic.

In an embodiment, the body of the male and female parts is closed on the rear side through which the conductors are introduced into the connector by a closure part made of flexible insulating material provided with passages for said conductors.

With respect to the body of the male part, the latter advantageously comprises, on the front side, from which the male contacts protrudingly extend, sealing boots overmoulded in flexible insulating material.

Advantageously, the boots are overmoulded with the closure part.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
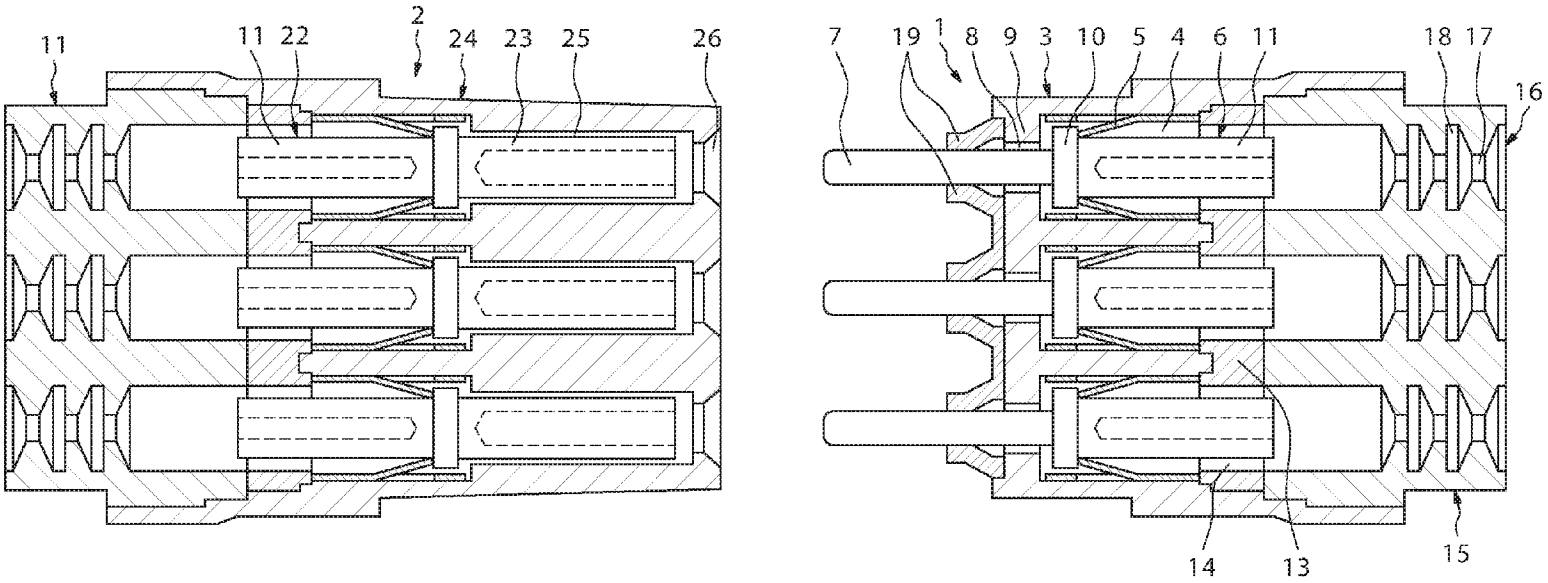
FIG.1 (PRIOR ART)
FIG. 1, illustrates the structure of a connector according to the prior art.
Figure 2:
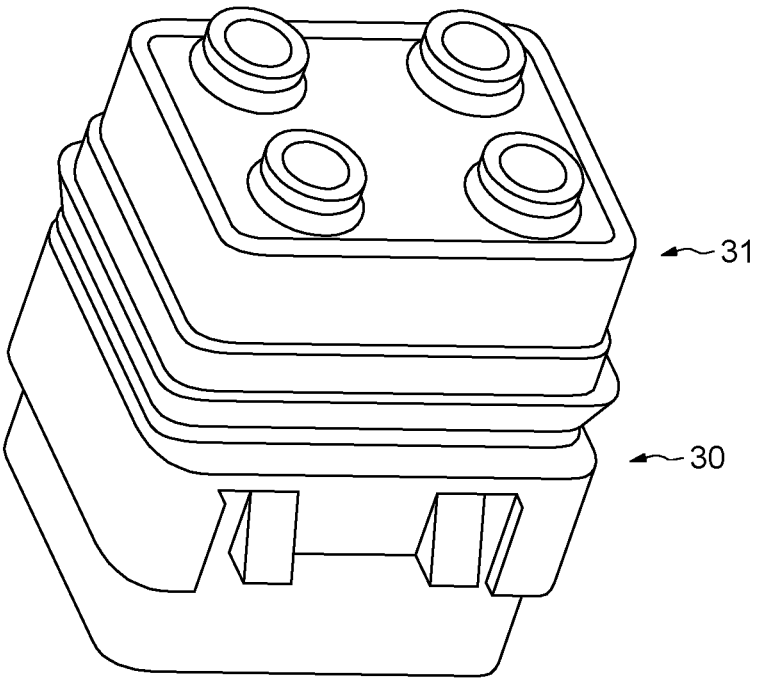
FIG. 2 is a perspective view of a connector according to the invention.

As illustrated in FIGS. 2, 3, 4 and 5, the connector according to the invention, designated by the general numeric reference 30, comprises two parts, namely a male part 31 and a female part 32. The male part 31 is intended to receive a male contact element (not represented) in pin form, whereas the female part 32 is intended to receive a female contact element in bushing form.

The male and female parts each comprise a body 33 and 34 (FIGS. 4 and 5) in which are formed a set of housings such as 36 extending along the entire height of the body to receive a pin 37, with respect to the male part, and a bushing 38, with respect to the female part.

In the example illustrated, the body comprises four housings 36 intended to receive four corresponding contact elements. Obviously, there is no departure from the scope of the invention when the body of the connector comprises any number of such housings intended to receive a corresponding number of male or female contact elements.

As can be seen, each male or female contact element 37 or 38 comprises a median collar 39 on which bears a generally tapered and elastically deformable retaining element 40, moulded with the body and formed, for example, by a set of elastically deformable tongues to ensure the holding of the contact element by snap fitting in the body.

As represented, each contact element comprises a rear section such as 41 provided with a blind hole 42 intended to receive a contact end fitting (not represented) fixed to the end of a conductor to be connected.

Figure 4:
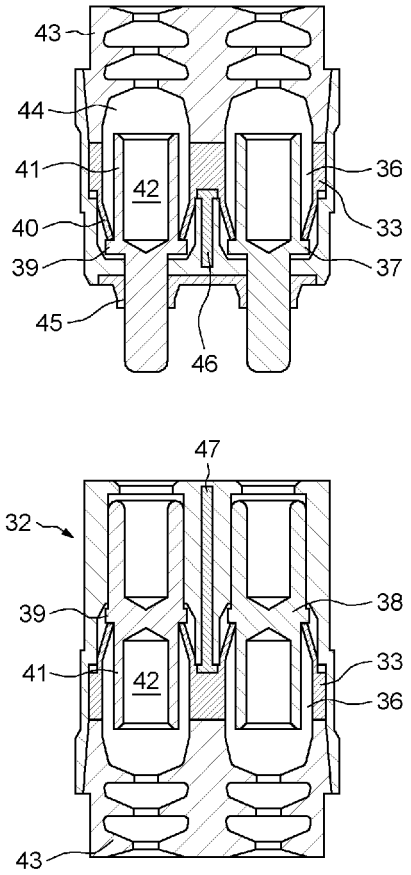
FIGS. 4 and 5 are views in longitudinal cross section along two respective perpendicular cutting planes of the male and female parts of a connector according to the invention.
Figure 5:
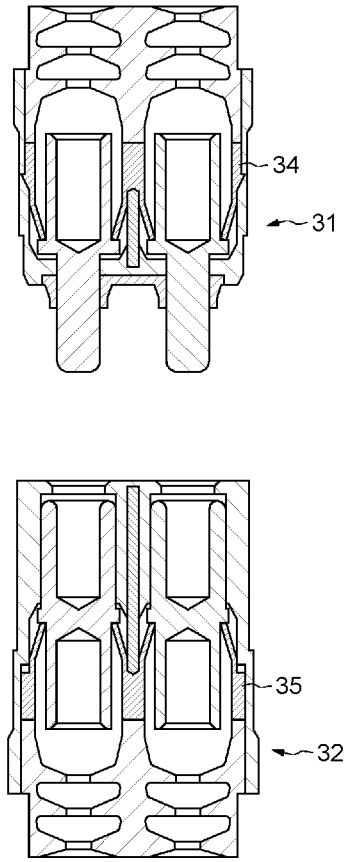

Referring to FIGS. 4 and 5, the height of the male part is such that the pins protrudingly extend beyond the body while the height of the female part is greater than that of the male part and is such that the bushings are entirely housed in the female part.

Thus, when the male part is assembled on the female part, the pins are inserted into the bushings to ensure the mechanical fixing and the electrical connection of the conductors provided with the contact end fittings inserted into the blind holes 42 of the pins and of the bushings.

It can also be seen in FIGS. 4 and 5 that the rear faces of the male and female parts, that is to say the faces situated opposite the connection area of the contact elements, comprise a closure part 43 made of flexible insulating material, for example silicone. This closure part 43 is provided with longitudinal passages 44 aligned with the housings 36, and comprises, for example, a succession of sections of small diameter and of sections of larger diameter to ensure the seal tightness with the electrical conductors inserted into the longitudinal passages 44.

Furthermore, with respect to the male part 31, the front face is provided with boots 45 made of an insulating flexible material, preferably consisting of the same flexible insulating material as the rear closure part 43.

The boots 45 are produced from one and the same moulded piece and are each formed by cone sections which grippingly surround the male ends of the pins to ensure the seal tightness between the pins and the male part and between the male and female parts.

It will be noted that, for example, the boots 45 can be produced simultaneously with the rear closure part 43 in an operation of overmoulding of the body 33.

Figure 3:
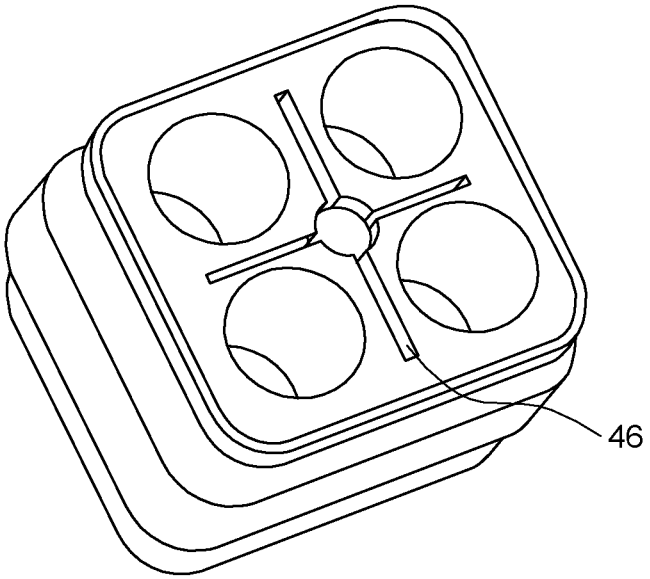
FIG. 3 is a transverse cross sectional view of the connector of FIG. 1 at the male part.

It can also be seen in FIGS. 3 and 4 that one or other of the male and female parts, preferably both the male and female parts, are provided internally with partitions 46 and 47 which extend between the housings 36 over at least a part of the height of the male and female parts.

These partitions are produced from a material capable of withstanding electrical discharges likely to occur notably upon the connection and the disconnections of the contact elements and which would, otherwise, be likely to affect the electrical insulation properties of the constituent material of the body.

Preferably, the constituent material of the partitions is a thermosetting polymer having a CTI index greater than or equal to 600. It is advantageously a silicone or an epoxy resin.

It can in particular be seen in FIGS. 4 and 5 that the partition 47 provided in the female part extends at least over the height of the electrical connection zone between the pins and the bushings and thus makes it possible to ensure protection of the body against the partial discharges and guarantee the electrical insulation of the body of the male and female parts in the long term.

The partitions 46 and 47 are advantageously produced in a step of overmoulding of the body.

Advantageously, the partitions, the rear part 43 and the boots 45 are produced from the same material withstanding partial discharges, in one and the same overmoulding operation.

In a variant, the partitions are produced in a thermosetting polymer such as a silicone or an epoxy resin and are consequently produced in a material different from that of the rear closure part 43 and of the boots 45.

While illustrative embodiments have been illustrated and described, it will be appreciated that various changes can be made therein without departing from the spirit and scope of the invention.

The embodiments of the invention in which an exclusive property or privilege is claimed are defined as follows:

1. A connector assembly for connecting electrical conductors, the connector assembly comprising: two conjugate parts, respectively a male part and a female part, each comprising a body made of insulating material provided with cavities into which respectively male and female contacts are mounted and are capable of receiving end-fittings of electrical conductors at least one of the male part and the female part comprises partitions embedded in and extending between each of said corresponding cavities and are made of a material comprising a thermosetting polymer having a comparative tracking index (CTI) greater than or equal to 600 capable of withstanding electrical discharges.

2. The connector assembly according to claim 1, in which the material of the partitions is a silicone.

3. The connector assembly according to claim 1, in which each partition extends into its respective, body along at least a part of a length of the respective cavity.

4. The connector assembly according to claim 1, in which the partitions are produced by overmoulding of said material capable of withstanding electrical discharges on the insulating material of the body.

5. The connector assembly according to claim 1, in which the insulating material of the body is made of thermoplastic.

6. The connector assembly according to claim 1, in which the body of the male part and the female part are closed on a rear side through which the electrical conductors are introduced into the connector assembly by a closure part made of flexible insulating material provided with passages for said electrical conductors.

7. The connector assembly according to claim 1, in which the body of the male part comprises, on a front side from which the male contacts protrudingly extend, sealing, boots overmoulded in flexible insulating material.

8. The connector assembly according to claim 1, in which the bodies of the male part and the female are closed on a rear side through which the electrical conductors are introduced into the connector assembly by a closure part made of flexible insulating material provided with passages for said electrical conductors, wherein the body of the male part comprises on a front side from which the male contacts protrudingly extend, sealing boots overmoulded in flexible insulating material, and wherein the boots are overmoulded with the closure part.

9. The connector assembly according to claim 1, wherein the thermosetting resin is chosen from an epoxy and a silicone.

10. The connector assembly according to claim 1, wherein the male contact of the male part is a pin and the female contact of the female part is a hushing, and wherein the female partition provided in the female part extends over at least a height of an electrical connection zone between the pin and the bushing.

11. The connector assembly according to claim 1, wherein the male part is provided with male partitions extending between the cavities over at least a portion of a height of the male part and the female part is provided with female partitions extending between the cavities over at least a portion of a height of the female part.

12. The connector assembly according to claim 11, wherein the male part is provided with boots and a rear side, and wherein the male partitions of the male part, the boots, and the rear side of the male part are produced from the same material capable of withstanding electrical discharges, in one and the same overmoulding operation.

* * * * *